US006087642A

United States Patent [19]

Joines et al.

[11] Patent Number: 6,087,642

[45] **Date of Patent: *Jul. 11, 2000**

[54] ELECTROMAGNETIC EXPOSURE CHAMBER FOR IMPROVED HEATING

[75] Inventors: William T. Joines; J. Michael Drozd, both of Durham, N.C.

[73] Assignee: Industrial Microwave Systems, Inc., Morrisville, N.C.

[ * ] Notice: This patent is subject to a terminal disclaimer.

[21] Appl. No.: 09/372,252

[22] Filed: Aug. 11, 1999

Related U.S. Application Data

[62] Division of application No. 08/813,061, Mar. 7, 1997, Pat. No. 5,998,774.

[51] Int. Cl.[7] ..... H05B 6/78

[52] U.S. Cl. ..... 219/693; 219/699; 219/745; 219/756

[58] Field of Search ..... 219/691, 692, 219/693, 695, 696, 697, 699, 700, 701, 738, 741, 742, 745, 746, 750, 756

[56] References Cited

U.S. PATENT DOCUMENTS

| | | | |
|---|---|---|---|
| Re. 32,664 | 5/1988 | Osepchuk . | |
| 2,543,053 | 2/1951 | Parker . | |
| 2,612,596 | 9/1952 | Gross . | |
| 2,820,127 | 1/1958 | Argento et al. . | |
| 2,943,174 | 6/1960 | Parker . | |
| 3,281,727 | 10/1966 | Niebuhr et al. . | |
| 3,553,413 | 1/1971 | Soulier . | |
| 3,555,232 | 1/1971 | Bleackley . | |
| 3,594,530 | 7/1971 | Wiegmann et al. . | |
| 3,843,861 | 10/1974 | Van Amsterdam . | |
| 3,848,106 | 11/1974 | Berggren et al. . | |
| 3,934,106 | 1/1976 | MacMaster et al. . | |
| 4,851,630 | 7/1989 | Smith . | |
| 4,940,865 | 7/1990 | Johnson et al. . | |
| 4,999,469 | 3/1991 | Dudley et al. . | |
| 5,142,114 | 8/1992 | Briggs et al. | 219/750 |
| 5,173,640 | 12/1992 | Geisler . | |
| 5,371,342 | 12/1994 | Saitoh . | |
| 5,402,672 | 4/1995 | Bradford . | |
| 5,432,325 | 7/1995 | Katz . | |
| 5,567,241 | 10/1996 | Tsu . | |

FOREIGN PATENT DOCUMENTS

| | | | |
|---|---|---|---|
| 2-265149 | 10/1990 | Japan | 219/695 |
| 1092861 | 11/1967 | United Kingdom | 219/696 |

OTHER PUBLICATIONS

M. Iskander, "FDTD Simulation of Microwave Sintering of Ceramics in Multimode Cavities," IEEE Transactions on Microwave Theory and Techniques, May 1994, pp. 793–800, vol. 42, No. 5.

R. Lauf, "2 to 18 GHz Broadband Microwave Heating Systems," Microwave Journal, Nov. 1993, pp. 24–34.

A. Van Koughnett, "A Waveguide TEM Mode Exposure Chamber," Journal of Microwave Power, 7(4), 1972, pp. 381–383.

(List continued on next page.)

*Primary Examiner*—Philip H. Leung
*Attorney, Agent, or Firm*—Burns, Doane, Swecker & Mathis, L.L.P.

[57] ABSTRACT

The present invention utilizes dielectric slabs to provide a relatively uniform electromagnetic field to a cavity between two or more dielectric slabs. Each dielectric slab is a thickness equal to or nearly equal to a quarter of a wavelength of the electromagnetic field in the dielectric slab. In a particular embodiment, sample material is introduced into the cavity between the two dielectric slabs. This sample material may be introduced through one or more openings in the dielectric slabs. In further embodiments, specialized choke flanges prevent the leakage of energy from this cavity. In a preferred embodiment, an elliptical conducting surface directs the electromagnetic field to a focal region between the two dielectric slabs. Openings to this focal region allow sample material to be passed through this region of focused heating.

13 Claims, 9 Drawing Sheets

OTHER PUBLICATIONS

G. Pine, "Comparison of Two–Dimensional Numerical Approximation and Measurement of SAR in a Muscle Equivalent Phantom Exposed to a 915 MHZ Slab–Load Waveguide," Int. Journal of Hyperthermia, vol. 6, No. 1, 1990, pp. 213–225.

A. Hudson, "Matching the Sides of a Parallel–Plate Region" (letter to editor), IRE Transactions on Microwave Theory and Techniques, Apr. 1957, pp. 161–162.

R. Herren, "A Inhomogeneously Filled Rectangular Waveguide Capable of Supporting TEM Propagation," IEEE Transactions on Microwave Theory and Techniques, Nov. 1971, pp. 884–885.

J. Bernhard et al, "Electric Field Distribution in TEM Waveguides Versus Frequency," Journal of Microwave Power and Electromagnetic Energy, vol. 30, No. 2, 1995, pp. 109–116.

ELECTROMAGNETIC EXPOSURE CHAMBER FOR IMPROVED HEATING

This application is a divisional, of Application Ser. No. 08/813,061, filed Mar. 7, 1997, now U.S. Pat. No. 5,998,774.

FIELD OF THE INVENTION

This invention relates to electromagnetic energy and more particularly to providing uniform electromagnetic exposure.

BACKGROUND OF THE INVENTION

In recent years, interest in using microwave signals for applications in many industrial and medical settings has grown dramatically. Some of these applications include using microwave power for heat treating various materials, polymer and ceramic curing, sintering, plasma processing, and for providing catalysts in chemical reactions. Also of interest is the use of microwaves for sterilizing various objects. These applications require electromagnetic exposure chambers or enclosures with relatively uniform power distributions. Uniform power distributions within the chambers help to prevent "hot" or "cold" spots which may cause unnecessary destruction or waste of sample material. Some of these applications also require that substances be passed through—rather than simply placed in—microwave chambers.

The prior art includes various attempts to achieve more uniform exposure of samples to microwave fields. Commercial microwave ovens utilize "mode stirrers", which are essentially paddle wheels that help create multiple modes within a microwave chamber. Many researchers have analyzed the use of multimode chambers for increasing uniformity of exposure. See Iskander et. al, FDTD Simulation of Microwave Sintering of Ceramics in Multimode Cavities, IEEE MICROWAVE THEORY AND TECHNIQUES, Vol. 42, No. May 5, 1994, 793–799. Some have suggested that the limited power uniformity achievable by mode stirring at a single frequency may be enhanced by using a band of frequencies. See Lauf et. al, 2 to 18 GHz Broadband Microwave Heating Systems, MICROWAVE JOURNAL, November 1995, 24–34.

Designers have focused on multimode cavities because single mode cavities are seen as inevitably producing a field with a very limited peak region. See Lauf at 24. But multi-mode cavities have yet to produce highly uniform fields across an entire cross section of a microwave chamber. Although these cavities result in a plurality of field peaks across a chamber, they have many hot and cold spots. For every energy peak in such a cavity, there is a corresponding valley. Attempts to fill in these valleys with the peaks of waves operating at different frequencies creates other problems. The use of large bandwidth swept frequency generators makes the apparatus expensive and inefficient, since power at some frequencies will be reflected back to the source.

The possibility of a dielectric slab-loaded structure that elongates the peak field region in a single mode cavity has been long—but not widely—recognized See A. L. Van Koughnett and W. Wyslouzil, A Waveguide TEM Mode Exposure Chamber, JOURNAL OF MICROWAVE POWER, 7(4) (1972), 383–383. Koughnett and Wyslouzil disclosed the theoretical existence of a slab-loaded chamber supporting TEM-mode propagation. However, they did not disclose a chamber with openings that facilitate the introduction of substances for exposure to a relatively uniform electromagnetic field.

A slab loaded structure has been used in a few limited applications as a microwave applicator. Specifically, a slab loaded guide has been tested for radiating microwaves into tissue-like samples. See G. P. Rine et. al, Comparison of two-dimensional numerical approximation and measurement of SAR in a muscle equivalent phantom exposed to a 915 MHz slab-loaded waveguide, INT. J. HYPERTHERMIA, Vol. 6, No. 1, 1990, 213–225.

Although used in the context of microwave applicators, dielectric slabs have not been pursued in the context of microwave chambers. In fact, most of the prior art accepts a nonuniform field as a given and attempts to achieve even heating by other means. For example, a recent sintering patent directed itself at wrapping samples in an insulating "susceptor" to uniformly distribute energy to samples placed in a nonuniform microwave field. U.S. Pat. No. 5,432,325.

Aside from the problems associated with field uniformity, use of microwaves in some applications has been limited by concerns over radiation. Chokes that prevent the escape of electromagnetic energy from the cracks between two contacting surfaces are well known in the art. Particularly well known are chokes designed for microwave oven doors and wave guide couplers. See, e.g., U.S. Reissue Pat. No. 32,664 (1988). However, many potential applications require a cavity that has access points that are continually open. For these applications, substances need to be passed through, rather than placed in, the cavity. The prior art has not fully explored the use of choke devices to prevent energy radiation in structures that have continually open access points.

In the context of microwave applicators, continually open access points pose no problem. The goal of such devices is to radiate energy. However, in the context of microwave chambers, where the goal is to energize only the space inside the chamber, continually open access points present potentially harmful sources of radiation. The problem of radiation through open access points is magnified when the substance being passed through the chamber has any conductivity. Such conductive substances (e.g., any ionized moisture in paper that is passed through a chamber for drying) can, when passed through a microwave chamber, act as an antenna and carry microwaves outside the cavity.

In many important areas, microwave systems are not in use at all due to the problems posed by nonuniform fields and the need for continually open access points. For example, medical tubing is still sterilized either by chemical baths or by electron beam radiation. However, microwave methods have distinct advantages over electron beam (UV) methods. Microwaves are less likely to structurally damage the tubing. Also, microwaves can achieve greater depth of penetration than UV radiation. Therefore, medical tubing is more permeable to microwaves than to UV radiation. Furthermore, microwaves can kill organisms and help destroy and remove debris throughout the tubing. UV radiation can only kill organisms at or near the tubing's surface but not effectively remove debris. Yet microwave structures are not currently employed for pre-use sterilization of medical tubing.

SUMMARY OF THE INVENTION

The present invention utilizes dielectric slabs to provide a relatively uniform electromagnetic field to a cavity between two or more dielectric slabs. Each dielectric slab is a thickness equal to or nearly equal to a quarter of a wavelength of the electromagnetic field in the dielectric slab.

In a particular embodiment, sample material is introduced into the cavity between the two dielectric slabs. This sample material may be introduced through one or more openings in the dielectric slabs.

In further embodiments, specialized choke flanges prevent the leakage of energy from this cavity.

In a preferred embodiment, an elliptical conducting surface directs the electromagnetic field to a focal region between the two dielectric slabs. Openings to this focal region allow sample material to be passed through this region of focused heating.

BRIEF DESCRIPTION OF THE DRAWINGS

The present invention will now be described with reference to the accompanying drawings in which.

DETAILED DESCRIPTION OF PREFERRED EMBODIMENTS

Figure 1:
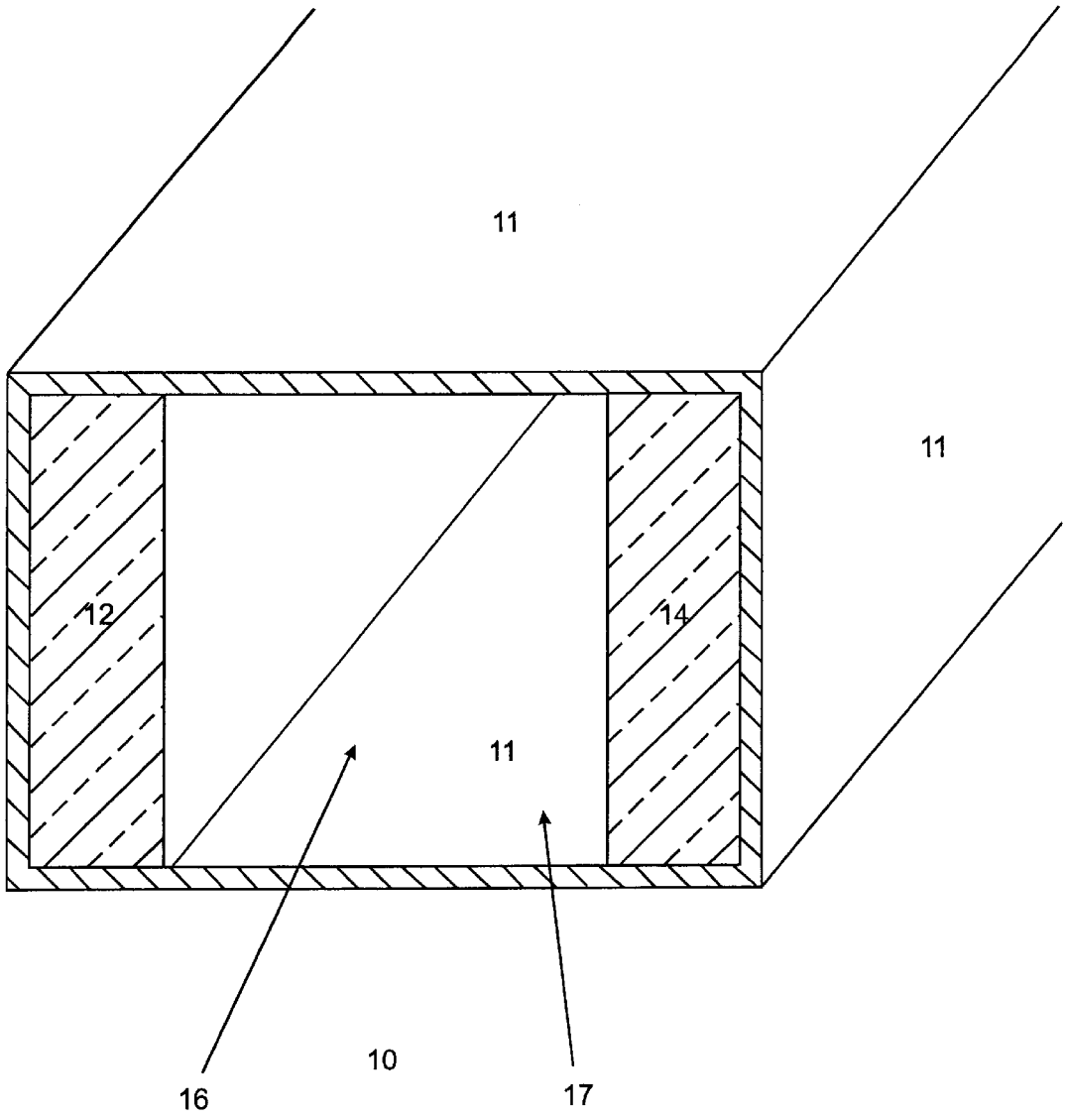
FIG. 1 is an electromagnetic exposure chamber in accordance with the present invention.

Referring now to the drawings, FIG. 1 illustrates an electromagnetic exposure chamber in accordance with the present invention. The electromagnetic exposure chamber 10 comprises an exterior surface 11 surrounding dielectric slabs 12 and 14. Dielectric slabs 12 and 14 may be parallel or not parallel.

The exterior surface 11 and dielectric slabs 12 and 14 form a cavity 16. The cavity 16 is filled with air or other dielectric material. In a preferred embodiment, the cavity 16 is filled with Styrofoam to provide stability to the electromagnetic exposure chamber 10.

The electromagnetic exposure chamber has an opening 17 through which electromagnetic energy (not shown) is propagated. The opening 17 may be attached to a traditional waveguide (not shown).

Figure 2:
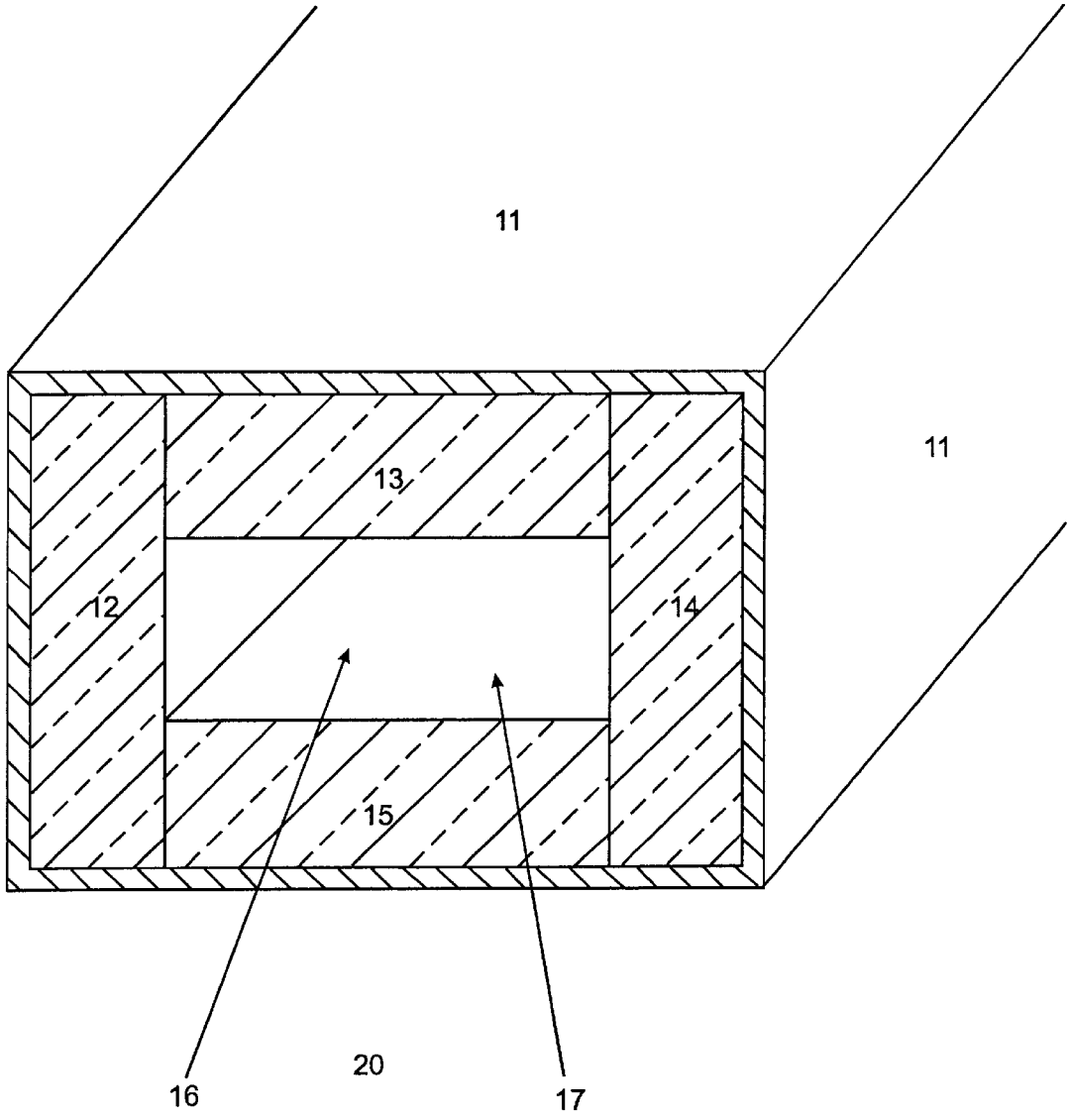
FIG. 2 is another electromagnetic exposure chamber in accordance with the present invention.

FIG. 2. illustrates another electromagnetic exposure chamber in accordance with the present invention. The electromagnetic exposure chamber 20 comprises an exterior surface 11 surrounding dielectric slabs 12, 13, 14, and 15. Dielectric slabs 12 and 14 may be parallel or may not be parallel. Dielectric slabs 13 and 15 may be parallel or may not be parallel. The dielectric slabs 12, 13, 14, and 15 form cavity 16. The electromagnetic exposure chamber 20 has an opening 17.

Figure 3:
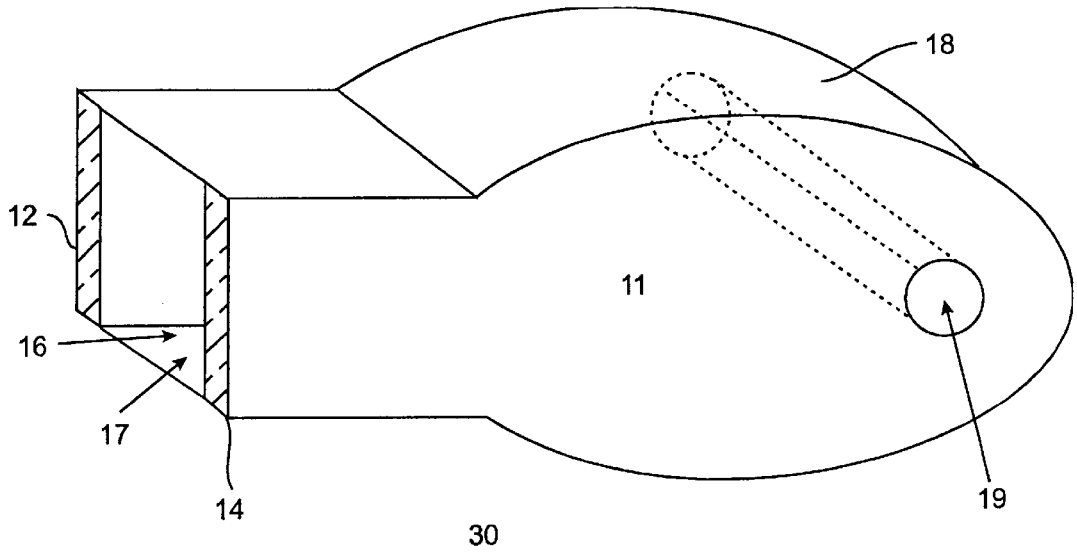
FIG. 3 is another electromagnetic exposure chamber in accordance with the present invention.

FIG. 3. illustrates another electromagnetic exposure chamber in accordance with the present invention. The electromagnetic exposure chamber 30 comprises an exterior surface 11 and dielectric slabs 12 and 14. The exterior surface 11 has a continuous, curved side 18 such that the inside surface of said side is an elliptical surface with a focal region 19. The dielectric slabs 12 and 14 and exterior surface 11 form a cavity 16. The electromagnetic exposure chamber 30 has an opening 17.

Dielectric slabs 12 and 14 may be formed of titania ($TiO_2$) ($\epsilon_r$ specified at 96.0±5%). The exterior surface 11 is formed of a conducting material such as aluminum. It is important that the presence of air gaps be minimized at the interfaces between exterior surface 11 and dielectric slabs 12 and 14.

Figure 4:
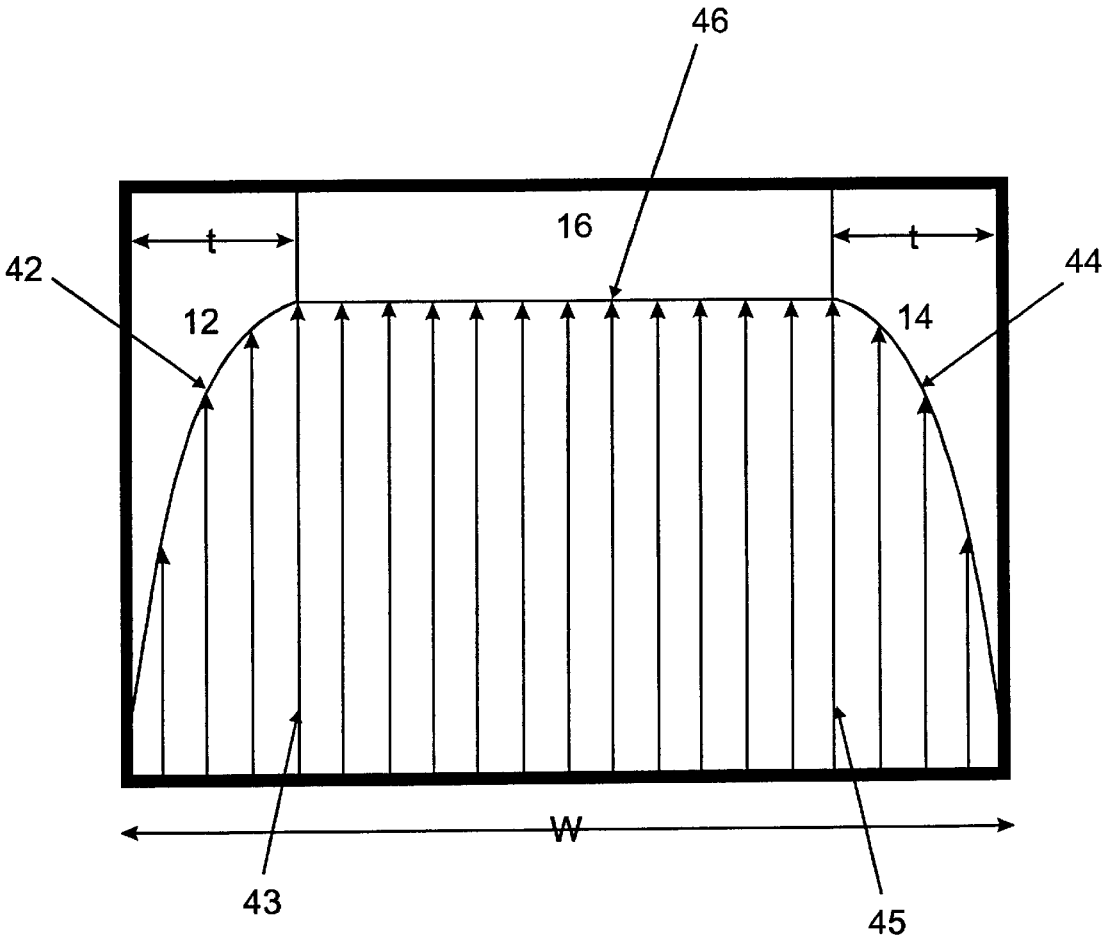
FIG. 4 is an illustration of a uniform electromagnetic field in a cross section of an electromagnetic exposure chamber in accordance with the present invention.

FIG. 4 illustrates a uniform electromagnetic field across a dimension of an electromagnetic exposure chamber in accordance with the present invention. The magnitude of the electric field 42, 44, and 46 in FIG. 4 is illustrated by vector arrows pointing in the vertical direction. The frequency of the electromagnetic wave (the operating frequency) can be 915 MHz, 2.45 GHz, or any other frequency depending on the desired application.

It is well known in the art that the wavelength $\lambda$ of an electromagnetic wave at a given frequency depends on the relative dielectric constant $\epsilon_r$ of the material in which the wave exists. This dependence is given by the equation $\lambda=(3\times10^8 m/s)\div(f)(\epsilon_r)^{1/2}$. Since the $\epsilon_r$ of the dielectric slabs is greater than the $\epsilon_r$ of the cavity, the wavelength of the electromagnetic field 42 and 44 in the slab material 12 and 14 is less than the wavelength of the electromagnetic field 46 in the material in the cavity 16.

In a preferred embodiment, the electromagnetic exposure chamber is designed for and operated at the same frequency (i.e., the operating frequency is equal to the design frequency). The electromagnetic exposure chamber is designed such that the thickness t of slabs 12 and 14 are each equal to a ¼ of the wavelength of the electromagnetic field 42 and 44 in the slabs 12 and 14. A ¼ wavelength is the distance between a point in the mode where the magnitude of the electric field is equal to zero and the next nearest point in the mode where the magnitude of the electric field is at a maximum.

Figure 5:
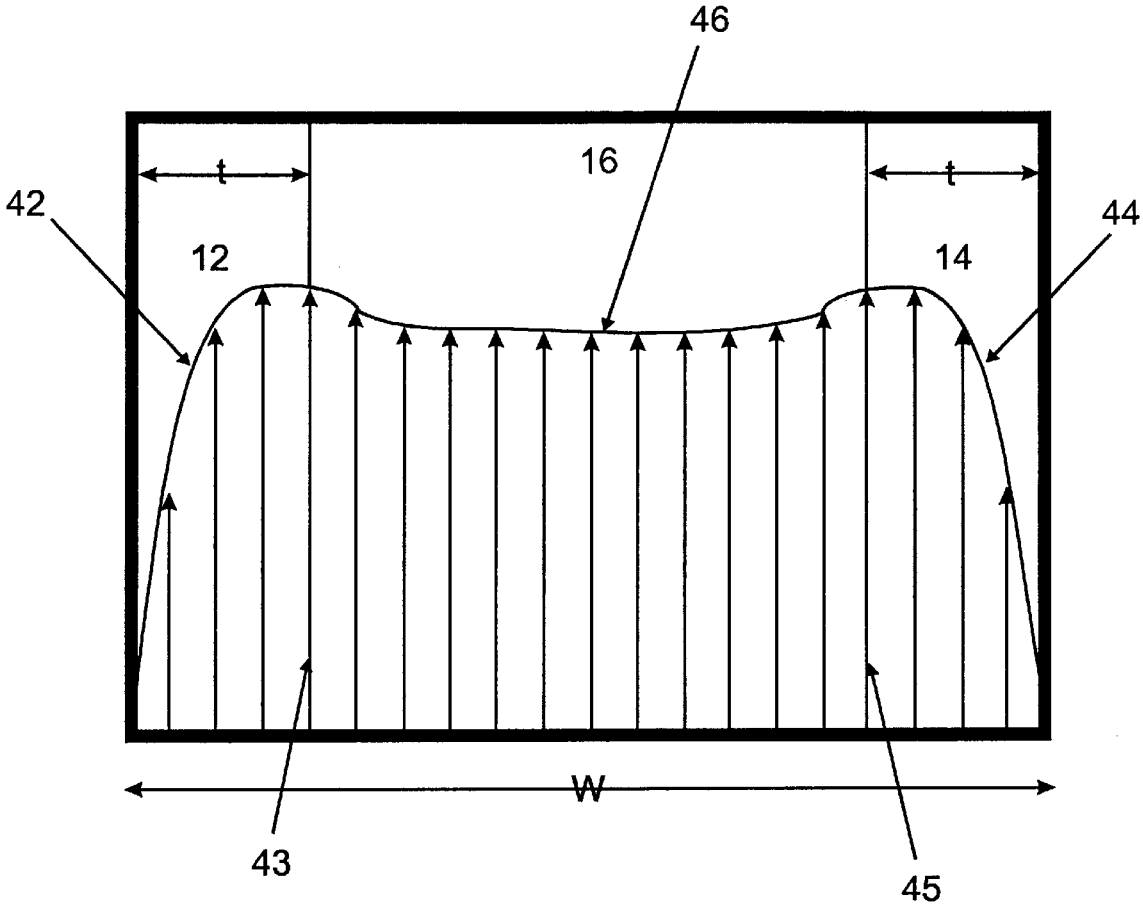
FIG. 5 is an illustration of a relatively uniform electromagnetic field in a cross section of an electromagnetic exposure chamber in accordance with the present invention.
Figure 6:
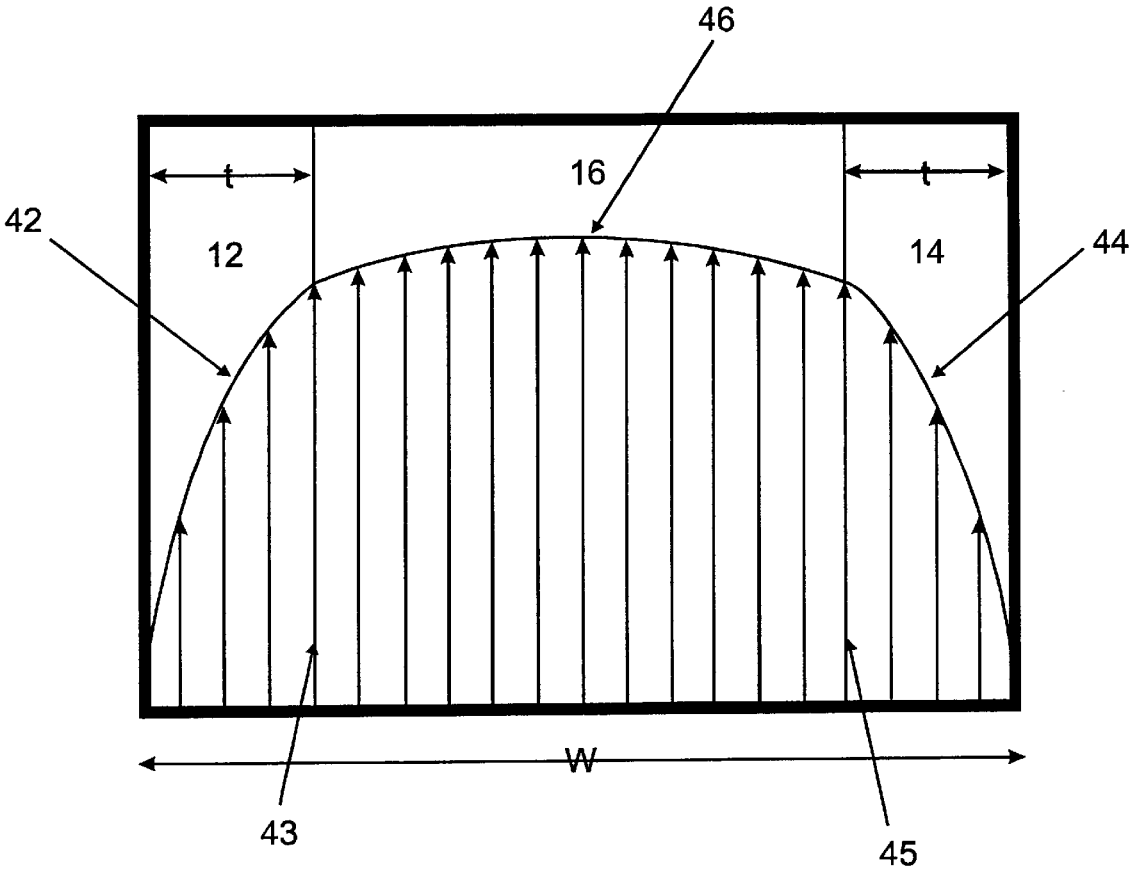
FIG. 6 is an illustration of another relatively uniform electromagnetic field in a cross section of an electromagnetic exposure chamber in accordance with the present invention.

Choosing a slab of thickness slightly greater or slightly less than a ¼ of a wavelength does not depart from the spirit of the present invention. As FIG. 5 illustrates, if the thickness t of slab 12 or 14 is slightly greater than $\lambda/4$, the peak of the electric field occurs within the slab 12 or 14 rather than at the edge of slab 12 or 14. As FIG. 6 illustrates, if the thickness t of slab 12 or 14 is slightly less than $\lambda/4$, then the peak of the electric field within cavity 16 exceeds the magnitude of the field at the edge 43 or 45 of the cavity 16, but is still relatively uniform across the cavity. Both FIG. 5 and FIG. 6 illustrate a relatively uniform electromagnetic field in a cross section of an electromagnetic exposure chamber in accordance with the present invention. Therefore, the phrase "equal to a ¼ of a wavelength" is hereinafter intended to mean equal to or about equal to a ¼ of a wavelength.

An advantage of the present invention is that the electric field is at a maximum at the inside edge 43 or 45 of the dielectric slab 12 or 14 (the outside edges of the cavity 16) and is uniform (or nearly uniform) throughout the cavity 16.

Because the electric field is at a maximum (or near a maximum) at the outside edges 43 and 45 of the cavity 16, the usable volume of the cavity is increased. In other words, the peak of the electromagnetic field is wider. In a cavity without dielectric slabs 12 and 14, the peak of the electromagnetic field is narrow. That is, the magnitude of the electromagnetic field significantly decreases at the outside edges 43 and 45 of the cavity 16.

It will be appreciated by those skilled in the art that the electromagnetic exposure chamber should also be designed and operated such that the electromagnetic wave is in a singular mode. The best way to ensure that the electromagnetic wave is in a singular mode is to limit the overall width w. (Width w combines the width of the cavity 16 and the thicknesses t of the dielectric slabs 12 and 14).

If the overall width w is held constant, the width of the cavity 16 (and hence cavity 16's usable volume) will be maximized by minimizing the width of the dielectric slabs 12 and 14. It will be appreciated by those skilled in the art that a ¼ of a wavelength at a given frequency is relatively smaller in a material that has a relatively large dielectric constant. Therefore, the width of the cavity 16 is maximized if the relative dielectric constant of the dielectric slabs 12 and 14 is increased. In sum, if the dielectric constant of the slabs is increased, the thickness t of the dielectric slabs 12 and 14 is decreased and the width of the cavity 16 is increased.

To insure that the electromagnetic wave will operate in a singular mode, the overall width w should be equal to or less than $2t[1+(\epsilon_{r1}/\epsilon_{r2}-1)^{1/2}]$, where $\epsilon_{r1}$ is the dielectric constant of the dielectric slabs 12 and 14, $\epsilon_{r2}$ is the dielectric constant of the material in the cavity 16, and 2t is the combined thickness of the dielectric slabs 12 and 14.

FIG. 5 illustrates a relatively uniform electromagnetic field in a cross section of an electromagnetic exposure chamber in accordance with the present invention. As mentioned above, the electromagnetic exposure chamber should be designed and operated at near the same frequency. If the electromagnetic exposure chamber is operated at above the design frequency (or if the dielectric slabs 12 and 14 are built too thick), the magnitude at the edge 43 or 45 of the cavity 16 is no longer at a maximum. The field shown in FIG. 5 occurs if the electromagnetic exposure chamber is operated at a frequency slightly greater than the design frequency. The peak of the electric field occurs within the slab 12 or 14 rather than at the edge 43 or 45 of the slab 12 or 14. The electric field 46 in the cavity 16 will exhibit a slight downward bow but will still be relatively uniform across the cavity 16.

FIG. 6 illustrates another relatively uniform electromagnetic field in a cross section of an electromagnetic exposure chamber in accordance with the present invention. The field shown in FIG. 6 occurs if the electromagnetic exposure chamber is operated at a frequency slightly less than the design frequency (or if the dielectric slabs are built too thin). The peak of the electric field 46 within the cavity 16 exceeds the magnitude of the electric field at the edge 43 or 45 of the cavity, but is still relatively uniform across the cavity 16.

If the electromagnetic exposure chamber is operated at well above the design frequency (or if width w is too wide), the electromagnetic wave will no longer be in its singular mode. However, if width w is less than $2t[1+(\epsilon_{r1}/\epsilon_{r2}-1)^{1/2}]$, the electromagnetic field will still be in its singular mode.

Figure 7:
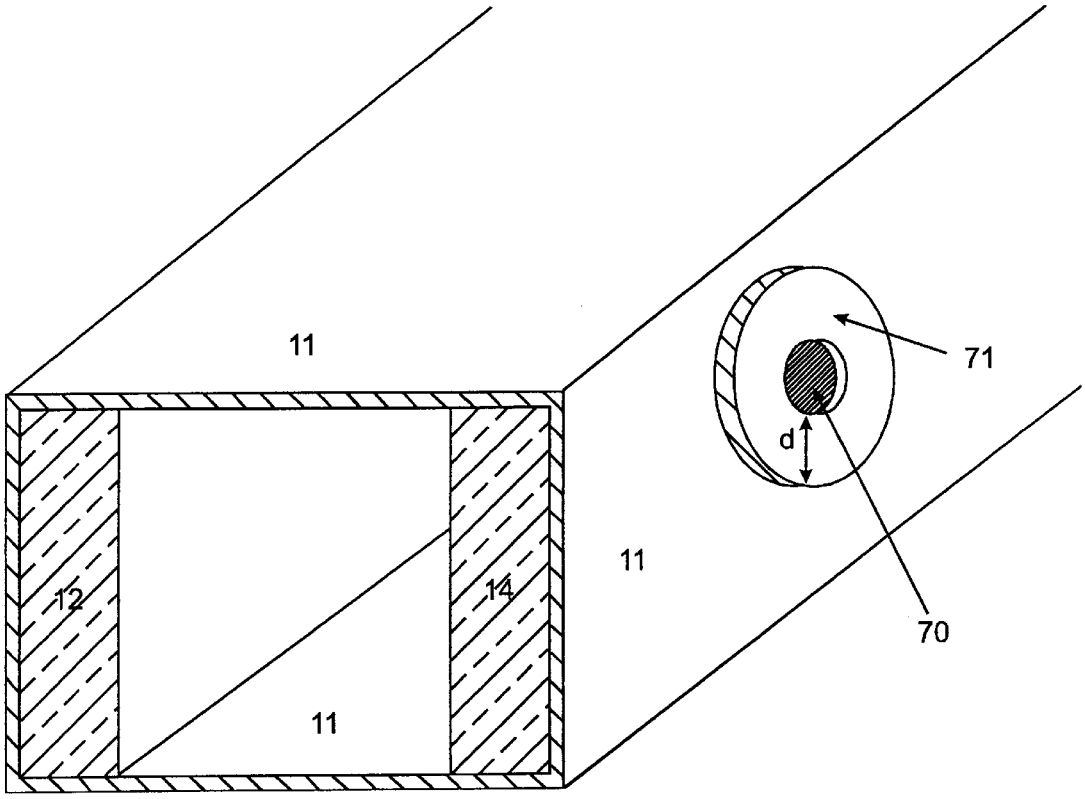
FIG. 7 is an opening in a dielectric slab with a choke flange.
Figure 8:
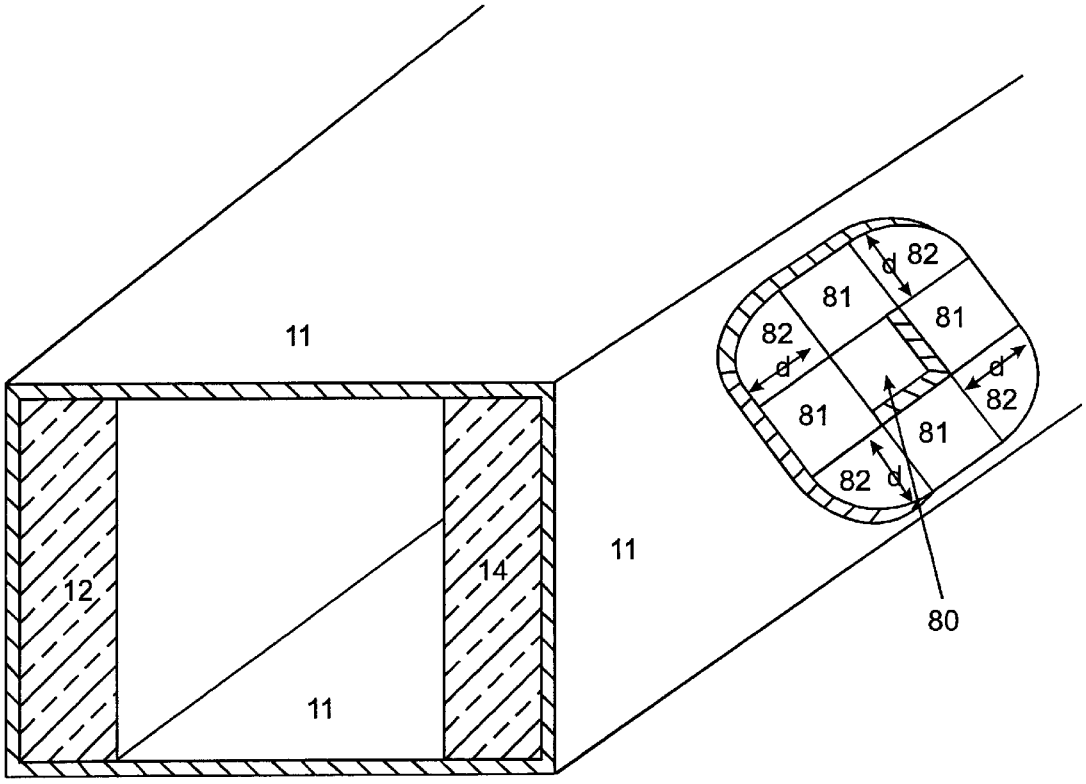
FIG. 8 is another opening in a dielectric slab with another choke flange.

Referring now to FIGS. 7 and 8, for many applications it may be desirable to introduce substances into the cavity 16 through openings in one or more of the dielectric slabs 12 and 14. It may also be desirable to add a choke flange to such openings to prevent the escape of electromagnetic energy from the cavity 16. Creating an open circuit around the outer perimeter of the opening prevents the escape of electromagnetic energy.

FIG. 7 illustrates a choke flange 71 appropriate for a circular opening 70. Choke flange 71 may consist of a hollow or dielectrically filled conducting structure. Choke flange 71 is shorted to the exterior conducting surface 11 at a distance d of λ/4 from the outer perimeter of the opening 70. λ/4 is measured with reference to the value of $\epsilon_r$ of the material inside the hollow or dielectrically filled choke flange 71. Although ideally the distance d should be equal to λ/4, choke flange 71 will still operate in accordance with the present invention if d is slightly greater or slightly less than λ/4.

FIG. 8 illustrates a choke flange 81 adapted to a rectangular opening 80. The choke flange 81 may consist of a hollow or dielectrically filled structure that is either in the shape of a rectangle (not shown), a piecewise simulation of a rectangle 81 only, or a modified rectangle 81 and 82 with rounded comers 82. The modified rectangle 81 and 82 with rounded comers 82 can be formed from a single piece of metal or separate pieces of metal. In the case of separate pieces of metal, the separate pieces of metal may have gaps therebetween.

The choke flange 81 is shorted to the exterior conducting surface 11 at a distance d of λ/4 from the outer perimeter of opening 80. λ/4 is measured with reference to the value of $\epsilon_r$ of the material inside the conducting structure 81. Again, the distance d may be slightly greater or slightly less than λ/4. Losses from opening 80's comers will typically be negligible. If desired, however, these negligible losses may be further eliminated by designing choke flange 81 to include rounded comers 82 of radius d short circuited at a distance d equal to or nearly equal to λ/4 from opening 80's comers.

Other shapes for opening/choke flange combinations will depend on the application. The choice of choke flange shape will depend on the opening shape which in turn will depend in part on the shape of the substance to be introduced into cavity 16.

Figure 9:
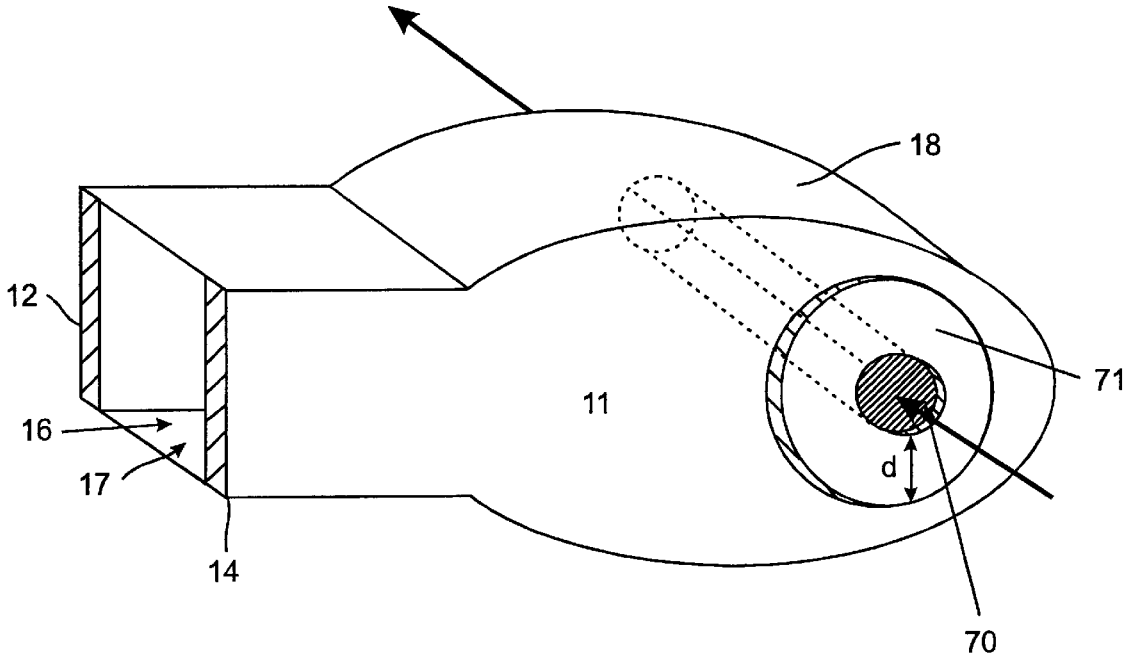
FIG. 9 illustrates an exemplary embodiment of the present invention that is particularly useful for sterilizing tubing and other applications.

FIG. 9 illustrates an exemplary embodiment of the present invention that is particularly useful for sterilizing tubing and other applications. A side 18 of exterior conducting surface 11 is formed in an elliptical shape. The elliptical shape of side 18 reflects the electromagnetic field to a focal region 19. A circular opening 70 is at a distal end of the focal region 19. A substance, such as tubing, may then be introduced into the focal region 19 of cavity 16 for exposure to a relatively uniform electromagnetic field. The embodiment illustrated in FIG. 9 is well adapted for sterilizing test tubes, or other elongated objects.

A single mode electromagnetic field may be delivered to the cavity by means well known in the art. To achieve the full benefits of uniform exposure in the preferred embodiment, the field should be polarized so that the electric field is oriented perpendicular to the longitudinal axis of the focal region.

In another embodiment, a tapered (i.e. gradually increasing in width) waveguide (not shown) is used to deliver the electromagnetic wave (not shown) from a traditional waveguide (not shown) to the opening 17 of the electromagnetic exposure chamber. In some embodiments the width of the cavity 16 will exceed that of the waveguide.

In a further embodiment the dielectric slabs 12 and 14 extend into the tapered waveguide in which case the dielectric slabs 12 and 14 are not parallel. If the dielectric slabs 12 and 14 are not parallel, this increases the usable volume of the cavity 16 and elongates the focal region 19.

This embodiment and other embodiments are also useful for sintering. Sintering often requires the heating of substances with relatively high melting points. Microwave heating offers the possibility that the heating times required for sintering may be significantly reduced. However, a substance to be sintered must be heated relatively evenly to permit even densification and to avoid cracking. For a discussion of temperatures and hold-times associated with the sintering of selected substances, see the disclosure of U.S. Pat. No. 5,432,325 incorporated herein by reference.

Another specialized application of the present invention relates to exposing substances to an electromagnetic field for the promotion of thin film deposition. For example, rapid thermal processing (RTP) of semiconductor wafers requires relatively uniform, but rapid, heating. For a discussion of wafer processing, see S. Wolf and R. N. Tauber SILICON PROCESSING FOR THE VLSI ERA (1986), incorporated herein by reference. The present invention enables enhanced field uniformity for helping to promote more uniform thin-film deposition in the context of semiconductor processing and in other thin-film deposition contexts.

Numerous variations or modification of the disclosed invention will be evident to those skilled in the art. It is intended, therefore, that the foregoing description of the invention and the illustrative embodiments be considered in the broadest aspects and not in a limited sense.

We claim:

1. An electromagnetic exposure chamber for heating a substance, the chamber comprising:

an exterior conducting surface that has two substantially parallel surfaces and an elliptical end, the elliptical end perpendicular to the two substantially parallel surfaces, the exterior conducting surface forming an interior cavity;

a first opening opposite the elliptical end for delivering an electromagnetic field to the interior cavity, the exterior conducting surface directing the electromagnetic field to a focal region of the interior cavity; and a second opening through a side of the exterior conducting surface, the second opening aligned with the focal region of the interior cavity.

2. A device as described in claim 1, the second opening allowing continuous introduction of a substance into the interior cavity.

3. A device as described in claim 2, the second opening allowing the substance to travel along the focal region through the interior cavity.

4. An electromagnetic exposure chamber for heating a substance, the chamber comprising:

an exterior conducting surface that has two substantially planar surfaces and a smooth curved end, the smooth curved end perpendicular to the two substantially planar surfaces, the exterior conducting surface forming an interior cavity;

a first opening opposite the smooth curved end for delivering an electromagnetic field to the interior cavity, the exterior conducting surface directing the electromagnetic field to a focal region of the interior cavity; and a second opening through a side of the exterior conducting surface, the second opening aligned with the focal region of the interior cavity.

5. A device as described in claim 4, the smooth curved end having an elliptical shape.

6. A device as described in claim 4, the second opening allowing continuous introduction of a substance into the interior cavity.

7. A device as described in claim 4, the second opening allowing continuous introduction of a substance into the interior cavity.

8. A device as described in claim 4, the second opening allowing the substance to travel along the focal region through the interior cavity.

9. A device as described in claim 4, the second opening allowing the substance to travel along the focal region through the interior cavity.

10. An electromagnetic exposure chamber, the chamber comprising:

an exterior conducting surface having a first substantially planar surface, a second substantially planar surface, a first end, and a second end;

the exterior conducting surface forming an interior cavity;

the first end having an opening for an electromagnetic wave, the electromagnetic wave forming an electric field; and the second end having an elliptical shape that directs the electromagnetic wave to a focal region that extends from the first substantially planar surface to the second substantially planar surface.

11. A device as described in claim 10, the device further comprising a second opening through the top surface.

12. A device as described in claim 11, wherein the second opening is a continuously open opening.

13. A device as described in claim 11, the second opening aligned with the focal region of the interior cavity.

* * * * *

UNITED STATES PATENT AND TRADEMARK OFFICE

CERTIFICATE OF CORRECTION

PATENT NO. : 6,087,642
DATED : July 11, 2000
INVENTOR(S) : William T. Joines et al.

It is certified that error appears in the above-identified patent and that said Letters Patent is hereby corrected as shown below:

Column 8,
Line 18, change "4" to -- 5 --;
Line 21, change "4" to -- 6 --;
Line 24, change "4" to -- 7 --.

Signed and Sealed this

Fifth Day of February, 2002

*Attest:*

*Attesting Officer*

JAMES E. ROGAN
*Director of the United States Patent and Trademark Office*